US009205542B2

(12) United States Patent
Dedrickson et al.

(10) Patent No.: US 9,205,542 B2
(45) Date of Patent: Dec. 8, 2015

(54) BOX WRENCH WITH SPLIT GEAR BODY AND INTERCHANGEABLE DRIVE INSERT

(75) Inventors: Ryan A. Dedrickson, Eau Claire, WI (US); Dennis A. Nowak, Jr., Franklin, WI (US)

(73) Assignee: Snap-on Incorporated, Kenosha, WI (US)

( * ) Notice: Subject to any disclaimer, the term of this patent is extended or adjusted under 35 U.S.C. 154(b) by 784 days.

(21) Appl. No.: 13/192,607

(22) Filed: Jul. 28, 2011

(65) Prior Publication Data

US 2013/0025416 A1 Jan. 31, 2013

(51) Int. Cl.
*B25B 17/00* (2006.01)
*B25B 21/00* (2006.01)

(52) U.S. Cl.
CPC ..... *B25B 21/004* (2013.01)

(58) Field of Classification Search
CPC ..... B25B 21/004
USPC ..... 81/57, 57.14, 57.3
See application file for complete search history.

(56) References Cited

U.S. PATENT DOCUMENTS

| | | | | |
|---|---|---|---|---|
| 341,986 | A | 5/1886 | Alapaw | |
| 1,271,648 | A | 7/1918 | Zabawa | |
| 1,811,666 | A * | 6/1931 | Foster | 81/57.13 |
| 2,376,575 | A * | 5/1945 | Cronan | 192/43.2 |
| 2,758,493 | A | 8/1956 | Goldwater | |
| 3,196,717 | A * | 7/1965 | Sheppard | 81/57.2 |
| 3,523,781 | A | 8/1970 | Leveque | |
| 3,535,960 | A * | 10/1970 | Borries | 81/57.14 |
| 3,602,071 | A | 8/1971 | Juhasz | |
| 3,620,105 | A | 11/1971 | Batten | |
| 3,987,692 | A | 10/1976 | Lesner et al. | |
| 4,064,772 | A * | 12/1977 | Boyd et al. | 81/57.13 |
| 4,095,494 | A | 6/1978 | Castoe | |
| 4,098,151 | A | 7/1978 | Bliss | |
| 4,258,595 | A | 3/1981 | Ramsey | |
| 4,362,072 | A | 12/1982 | Tillman | |
| 4,506,567 | A * | 3/1985 | Makhlouf | 81/57.3 |

(Continued)

FOREIGN PATENT DOCUMENTS

| | | |
|---|---|---|
| CN | 201619060 U | 11/2010 |
| CN | 201664893 U | 12/2010 |
| TW | 186569 | 7/1992 |

OTHER PUBLICATIONS

International Preliminary Report on Patentability dated Feb. 6, 2014, in connection with the applicant's corresponding PCT Application PCT/US2012/046168 filed on Jul. 11, 2012.

(Continued)

*Primary Examiner* — Hadi Shakeri
*Assistant Examiner* — Danny Hong
(74) *Attorney, Agent, or Firm* — Seyfarth Shaw LLP

(57) ABSTRACT

A tool that includes an interchangeable drive head and a split gear body for transmitting torque to the drive head. The compact nature of the split gear body allows for an automatic power means, for example, an electric or air motor, to supply torque through the split gear body into the interchangeable drive head. Further, the interchangeable drive head includes a gear that is positioned around a receiving portion for receiving a head of a workpiece, so that the interchangeable drive head itself is part of the gear assembly. The above structure allows for a compact design while still allowing for an automatic power means to transmit the torque to the workpiece.

14 Claims, 4 Drawing Sheets

(56) References Cited

U.S. PATENT DOCUMENTS

| | | | | |
|---|---|---|---|---|
| 4,827,810 | A | 5/1989 | Rushanan | |
| 4,928,558 | A * | 5/1990 | Makhlouf | 81/57.3 |
| 5,107,729 | A | 4/1992 | Makhlouf | |
| 5,339,710 | A * | 8/1994 | Deadmond et al. | 81/57.3 |
| 5,355,751 | A | 10/1994 | Specht | |
| 5,501,107 | A * | 3/1996 | Snyder et al. | 73/862.23 |
| 5,537,897 | A * | 7/1996 | Wilson, Jr. | 81/56 |
| 5,544,553 | A * | 8/1996 | Galat | 81/57.3 |
| 5,584,220 | A * | 12/1996 | Darrah et al. | 81/57.29 |
| 5,732,605 | A * | 3/1998 | Mann | 81/57.3 |
| 6,050,165 | A * | 4/2000 | Hall | 81/63.1 |
| 6,559,613 | B1 | 5/2003 | Elliott et al. | |
| 7,044,029 | B1 | 5/2006 | Hopper, Jr. et al. | |
| 7,089,827 | B2 * | 8/2006 | Wexler | 81/57.29 |
| 7,628,098 | B2 * | 12/2009 | Kimberly | 81/57.29 |
| 7,934,440 | B2 | 5/2011 | Samudosky | |
| 8,291,791 | B2 * | 10/2012 | Light et al. | 81/57.16 |
| 8,322,255 | B1 * | 12/2012 | Jordan et al. | 81/57.14 |
| 2009/0025516 | A1 | 1/2009 | Samudosky | |

OTHER PUBLICATIONS

International Search Report, Int'l. Application No. PCT/US2012/046168, dated Sep. 12, 2012; 2 pgs.

Written Opinion of the International Search Authority, Int's Application No. PCT/US2012/046168; dated Sep. 12, 2012; 10 pgs.

Taiwan Patent Office Search Report, dated Aug. 20, 2014, 10 pgs.

Notification of the First Office Action, State Intellectual Property Office of the P.R. China, dated Nov. 3, 2014; with its English Translation, 9 pages.

* cited by examiner

BOX WRENCH WITH SPLIT GEAR BODY AND INTERCHANGEABLE DRIVE INSERT

FIELD OF THE INVENTION

The present application relates generally to powered tools for rotating workpieces. More particularly, the present application relates to powered tools for rotating a workpiece by transmitting torque from a split gear body to a removable drive insert.

BACKGROUND OF THE INVENTION

Ratchet sets are well-known tools that are used to rotate a workpiece and fasten two objects together. For example, a user can tighten a workpiece by rotating the ratchet, and can return the ratchet to its original position by rotating the ratchet in the opposite direction, which will not rotate the workpiece. Ratchet sets are typically hand-powered, and pneumatically-powered ratchet sets are typically bulky and space consuming. Thus, a need exists for a more compact ratchet set that is powered by pneumatic or other automatic means.

Ratchet sets also include a socket that is adapted to engage a workpiece to apply torque to the workpiece. The socket can be, for example, hexagonally shaped to fit around a hexagonally-shaped head of the workpiece. When the user rotates the ratchet, the socket applies torque to the workpiece to fasten or unfasten the workpiece. Conventional sockets are interchangeable with the ratchet by including a friction fit, detent, or locking design so that the socket can engage with corresponding mating portions of the ratchet. However, this structure is difficult to adapt into a more automatic means of powering the tool other than by manual user power, because the socket is only mechanically joined with the ratchet and does not include any functional interface with the ratchet.

SUMMARY OF THE INVENTION

The present application relates to a power tool with a split gear body that rotates a gear assembly, and that indirectly rotates a removable drive insert component for transmitting torque to a workpiece. In particular, the present application discloses a tool including a base, a motor coupled to the base, a gear train in functional communication with the motor, and an interchangeable drive insert engaged with the gear train, the interchangeable drive insert including a receiving portion adapted to engage a workpiece and apply rotational force thereto, and a plurality of gear teeth adapted to engage and be driven by the gear train.

Also disclosed is a tool including a motor, a drive body in functional communication with the motor, the drive body including an upper gear and a lower gear and a first pinion gear disposed therebetween, a second pinion gear engaged with the first pinion gear, an idler gear engaged with the second pinion gear, and a ratchet gear engaged with the idler gear, the ratchet gear adapted to apply rotational force to a workpiece based on torque transmitted by the idler gear.

Further disclosed is a tool including an idler gear, and an interchangeable drive insert that includes a ratchet gear having gear teeth on an external radial portion thereof and including a radial opening that extends between first and second endpoints of the ratchet gear and that is shaped and sized to receive a workpiece therein, and an insert cavity adapted to receive the ratchet gear and allow rotational movement thereof and including an opening shaped and sized to cooperate with the radial opening of the ratchet gear and permit entry of a workpiece therein, wherein the insert cavity is positioned adjacent the idler gear such that at least one point of the ratchet gear is engaged with the idler gear during a full radial movement of the ratchet gear.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
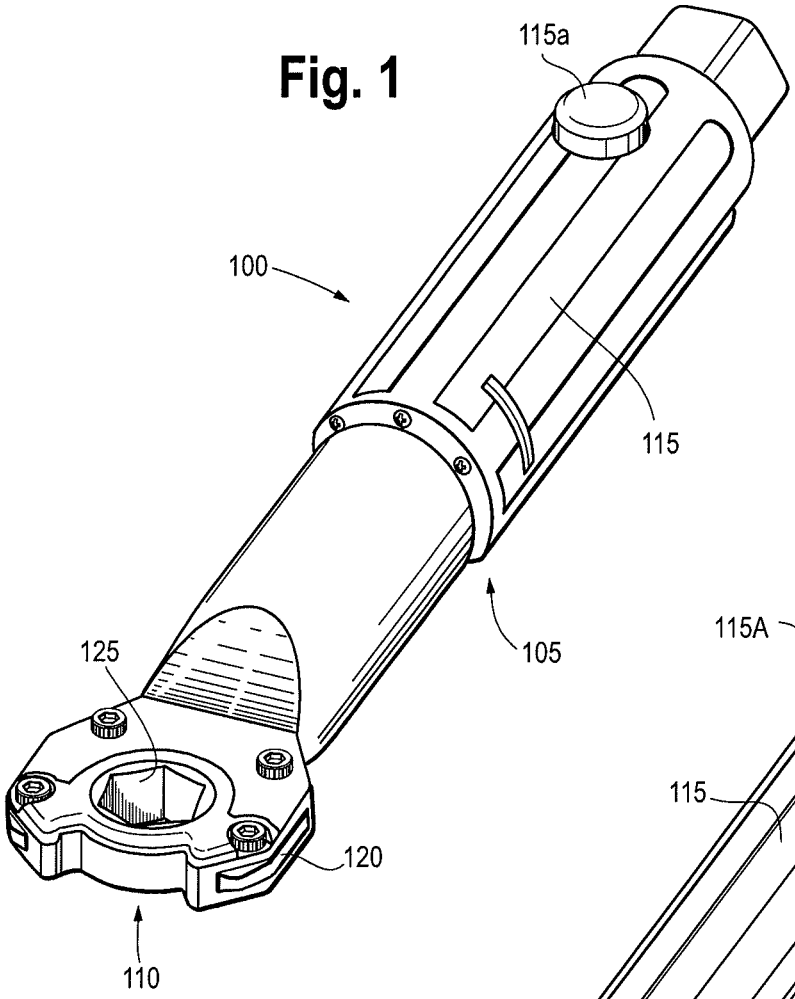
FIG. 1 is a perspective side view of a tool in accordance with an embodiment of the present application.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

The present application discloses an apparatus, method and system for transmitting power to a workpiece. FIG. 1 depicts a tool 100 including a main body 105 and a drive head 110 that is interchangeable with the main body 105. The main body 105 can include a motor 115 with an attached button 115A that is adapted to actuate the motor 115 to transmit mechanical energy through the tool 100. Lever arms 120 are provided on the drive head 110 to releasably engage the drive head 110 with the main body 105. The drive head 110 also defines a receiving portion 125 adapted to engage a workpiece, for example, a bolt with a hexagonal head, and to transmit torque from the tool 100 to the workpiece. In an embodiment, the drive head 110 is configured as a box-ended wrench.

Figure 2:
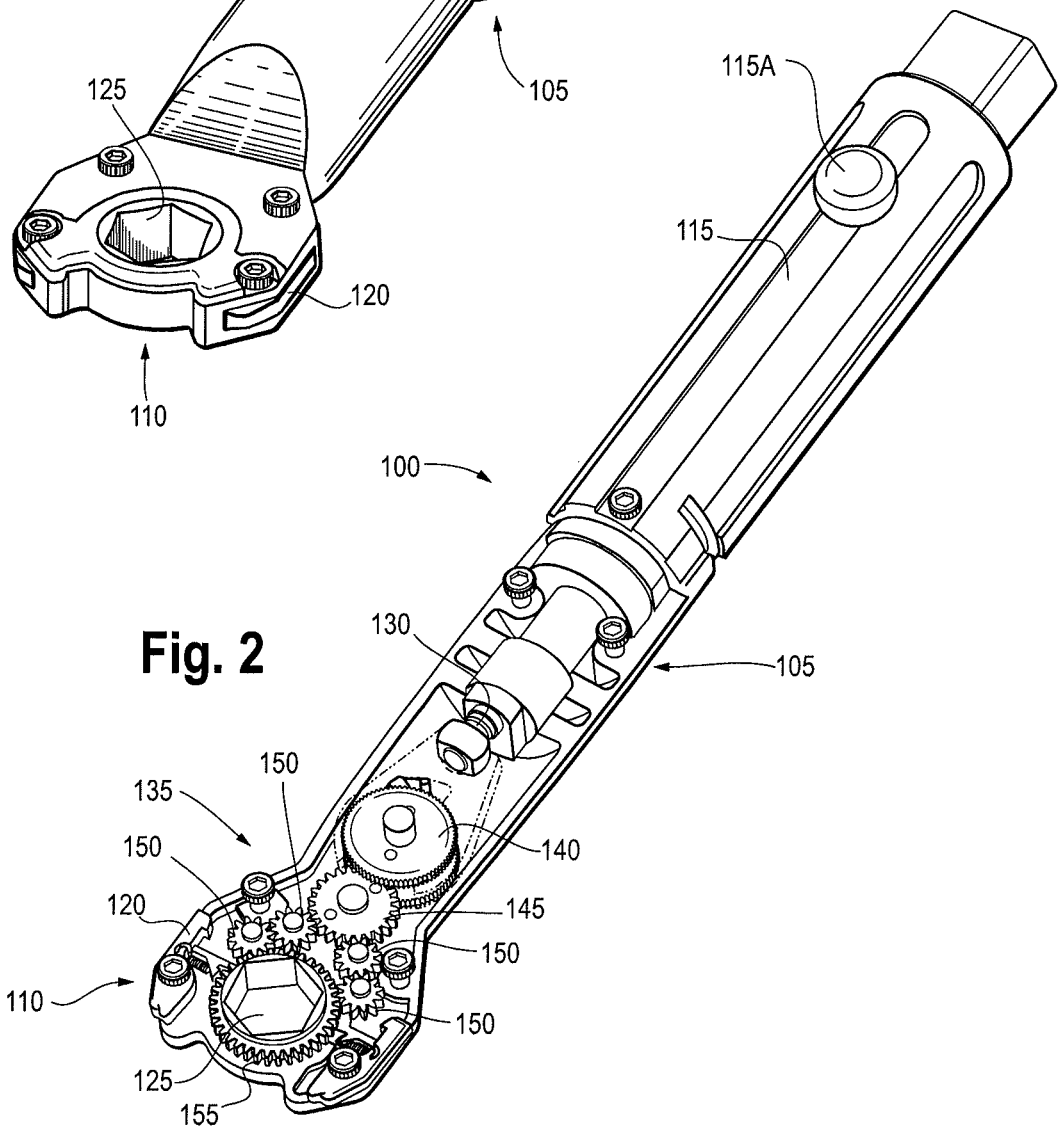
FIG. 2 is a perspective side, partial cross-sectional view the tool of FIG. 1.
Figure 3:
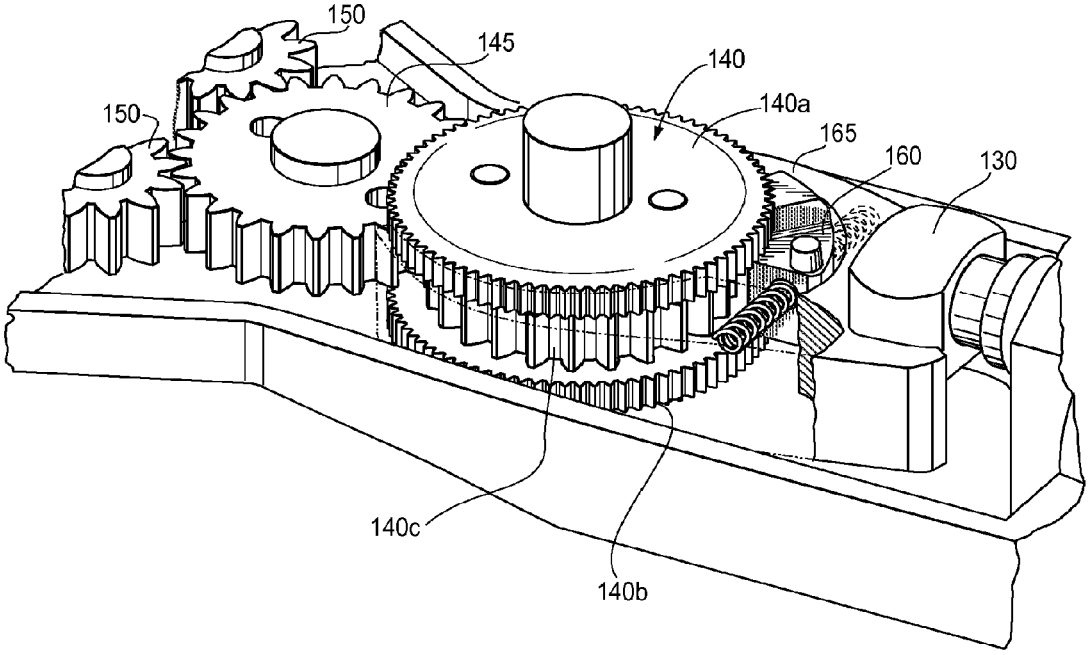
FIG. 3 is an enlarged, perspective side view of the tool of FIG. 1.

FIG. 2 illustrates the tool 100 of FIG. 1 with the external casing removed to reveal an embodiment of the internal components of the tool 100 and illustrate the structural configuration thereof. As shown, the tool 100 transmits power from the motor 115 through the offset crank 130 to the gear train 135. The gear train 135 transmits torque from the motor 115 through various gears and to the drive head 110 in order to rotate a workpiece (not shown). For example, the motor 115 can transmit power to a drive body 140 via offset crank 130. The drive body 140 can then transmit torque to a pinion gear 145, which thereby transmits torque to one or more idler gears 150, and ultimately to ratchet gear 155 of the drive head 110, which is adapted to apply torque directly to the workpiece.

The motor 115 can be any form of motor, for example electric, pneumatic, hydraulic or manually-powered, that is adapted to transmit torque indirectly or directly to the ratchet gear 155 to rotate a workpiece. As discussed, a user can actuate the motor 115 by pushing on a button 115*a*, and can deactivate the motor 115 by pushing on the button 115*a* a second time. Alternate forms of turning the motor on and off can be provided without departing from the scope and spirit of the present application. Also, the motor 115 can have different modes of power output (e.g., low, medium, and high) where button 115*a* can actuate the motor 115 between these different power outputs through successive actuations of the button 115*a*.

The drive body 140 can include an upper gear 140*a*, a lower gear 140*b*, and a pinion gear 140*c* disposed in between the upper gear 140*a* and the lower gear 140*b*. A pawl gear 160 can be spring loaded against the drive body 140 in order to limit rotational movement of the drive body 140 in at least one rotational direction.

As shown, the pawl gear 160 is meshingly engageable with a plurality of teeth of the upper gear 140*a* and the lower gear 140*b*, but is not coupled to the pinion gear 140*c*. This split gear body affords a more compact design and further maintains a symmetric loading on the pawl gear 160 when coupled to the upper gear 140*a* and lower gear 140*b*. The pawl gear 160 can also engage each of the upper gear 140*a*, lower gear 140*b* and pinion gear 140*c* to more securely hold the gears during rotational movement of the ratchet.

In an embodiment, the upper gear 140*a* and lower gear 140*b* can be thinner and wider relative to the pinion gear 140*c*. However, the drive body 140 can be structured differently. For example, the pinion gear 140*c* can be wider than the upper gear 140*a* and the lower gear 140*b*, and the pawl gear 160 can be split in two portions in order to provide a symmetric load on the drive body 140.

The pinion gear 145 engages the pinion gear 140*c* of the drive body 140 to transmit torque from the drive body 140 to the idler gears 150. The pinion gear 145 can be positioned at approximately mid-plane in the tool 100 so as to have sufficient clearance from the top and bottom of the case enclosing the tool components. As shown, the pinion gear 145 includes similar features as the pinion gear 140*c*. However, the pinion gear 145 can be of a different shape, size, material, structure, or appearance from that of the pinion gear 140*c* without departing from the spirit and scope of the present application.

The idler gears 150 are adapted to transmit torque from the pinion gear 145 to the ratchet gear 155. As shown, the idler gears 150 are provided on two sides of the ratchet gear 155, and include two idler gears 150 on each side: one idler gear 150 that meshingly engages the pinion gear 145, and a second idler gear 150 that meshingly engages the ratchet gear 155. In an embodiment, one idler gear 150 is provided and the tool 100 still functions as intended. For example, one idler gear 150 can be disposed intermediate the pinion gear 145 and the ratchet gear 155 to transmit torque from the drive body 140 to the ratchet gear 155. Further, idler gears 150 need not be disposed on multiple sides of the ratchet gear 155, and only one set of idler gears 150 can be disposed in engagement with the ratchet gear 155. In another embodiment, no idler gears 150 are necessary, and pinion gear 145 meshingly engages directly with the ratchet gear 155 to provide torque to the ratchet gear 155.

In an embodiment, the ratchet gear 155 is a gear provided on the drive head 110 and is adapted to transmit torque from the idler gears 150 to a workpiece. As shown, the ratchet gear 155 has an internal opening that defines the receiving portion 125 for receiving a head of a workpiece. The receiving portion 125 engages and rotates the workpiece with torque transmitted from the motor 115 to the ratchet gear 155. In an embodiment, the ratchet gear 155 is not integral with a structure that defines the receiving portion 125, and can be separate therefrom.

Figure 4:
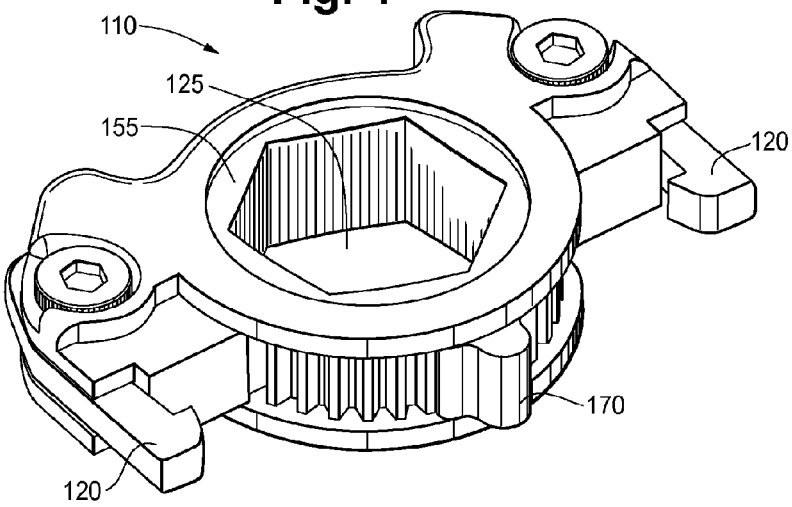
FIG. 4 is a side perspective view of a removable drive insert component of the present application.

FIG. 4 illustrates an embodiment of the drive head 110 in accordance with the present application. The drive head 110 defines a receiving portion 125 for engaging with a head of a workpiece to rotate the workpiece. The drive head 110 is adapted to be releasably retained on the main body 105 of the tool 100 by the lever arms 120, and is further supported within the main body 105 by a support 170.

The lever arms 120 can be any structure that allows the drive head 110 to releasably engage the main body 105 of the tool 100. For example, the lever arms 120 can be resiliently biased against receiving portions of the main body 105 by way of a biasing structure, such as springs. Alternately, the lever arms 120 can be magnetically coupled to corresponding magnetic structures on the main body 105 of the tool 100 in order to releasably hold the drive head 110 thereon. The support 170 can be any structure that is adapted to support the drive head 110 within the main body 105 of the tool 100. In an embodiment, and as shown, the support 170 is a small column that extends between the two sets of idler gears 150 and is adapted to support the drive head 110 within the inside of the tool 100.

The drive head 110 provides a convenient and releasable structure wherein a user can actuate the lever arms 120 to remove the drive head 110 from the main body 105 of the tool 100. Further, the drive head 110 may include gear teeth disposed on the ratchet gear 155 that engage directly with the idler gears 150 on the main body 105. Thus, a more compact design can be obtained that allows for the motor 115 to transmit power to a releasable drive head 110 and eventually to a workpiece disposed within the receiving portion 125 of the drive head 110.

Figure 5A:
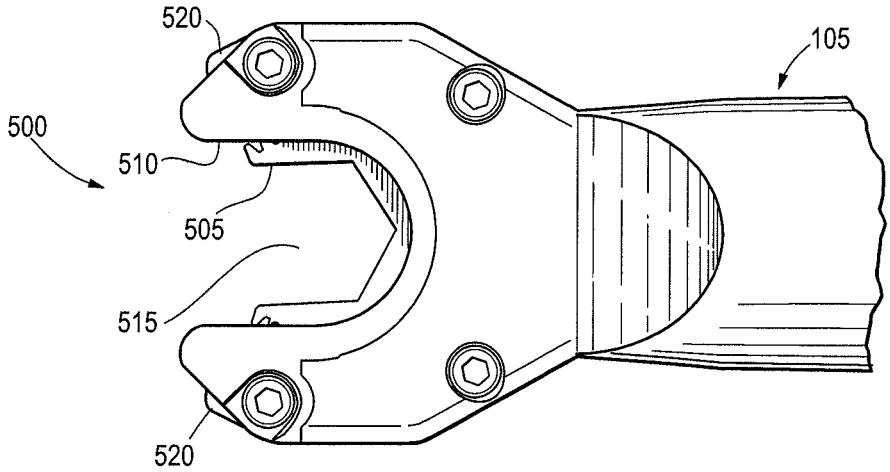
FIG. 5A is a side plan view of an open ended driver embodiment of the present application.
Figure 5B:
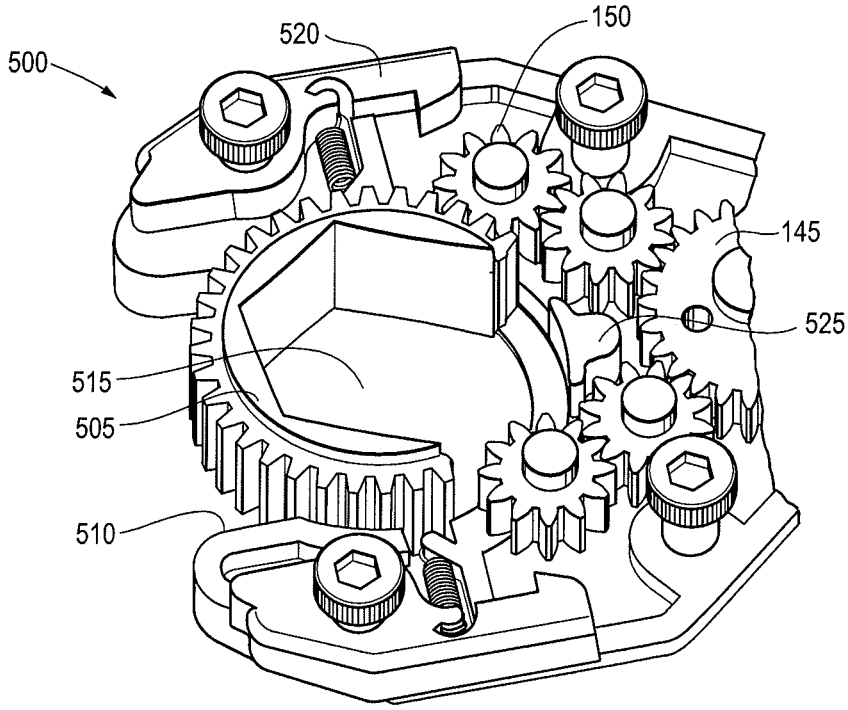
FIG. 5B is an enlarged internal view of the open ended driver embodiment.

FIG. 5A depicts an embodiment of an open-ended engagement driver 500 of the present application. The open-ended driver 500 can be an interchangeable drive insert, similar to the drive head 110 disclosed above. The open-ended driver 500 differs from the drive head 110 in that the open ended driver 500 allows easier access to hard to reach or "tight quartered" fasteners where a traditional box-end wrench configuration could not reach the fastener.

As shown in FIG. 5A, the open-ended driver 500 includes an open ratchet gear 505 disposed within an insert cavity 510 and including an opening 515 defined therein. The open-ended driver 500 can be releasably coupled to the tool 100 by lever arms 520, similar to the lever arms 120 discussed above. Also, a support 525 can be provided that extends from the insert cavity 510 to further guide the ratchet gear 505 within the insert cavity 510.

The open-ended ratchet gear 505 is similar to the ratchet gear 155 discussed above, except that the open-ended ratchet gear 505 is arcuately shaped. The opening 515 of the ratchet gear 155 allows a workpiece to be radially inserted into the ratchet gear 505, and further allows the ratchet gear 155 to transmit torque to the workpiece without the necessity to axially engage the workpiece with the tool 100.

The insert cavity 510 includes a radial boundary that is adapted to allow the open-ended ratchet gear 505 to rotate and meshingly engage one or more of the idler gears 550. The open ratchet gear 505 is disposed within the insert cavity 510 such that at least one point of the ratchet gear 505 is engaged with the idler gear(s) 150 during full radial movement of the ratchet gear 505. The geometry of the insert cavity 510 thus allows uninterrupted power transmission to the ratchet gear 505.

Figure 6:
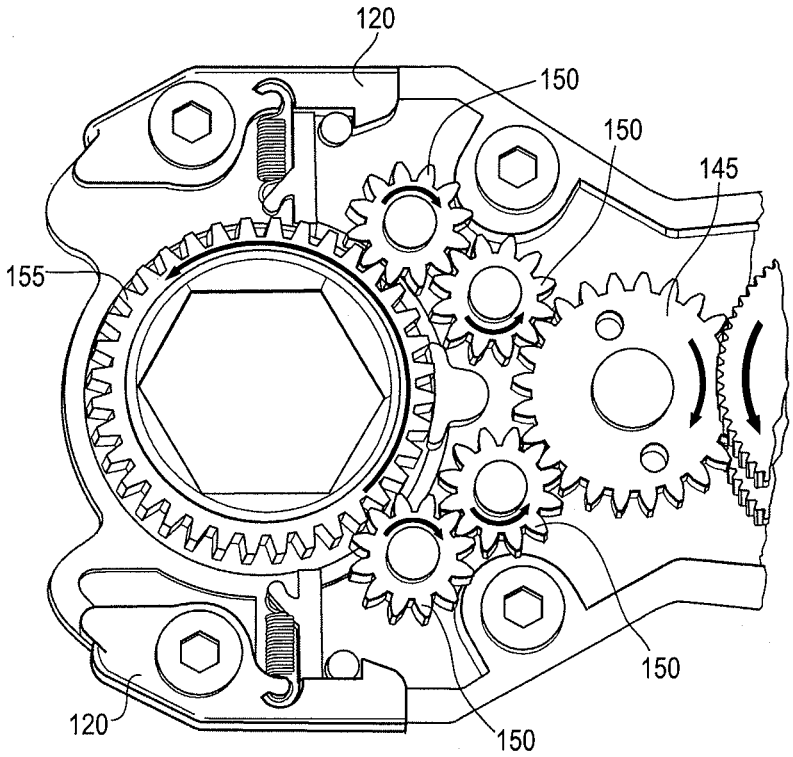
FIG. 6 is an enlarged side view of the removable drive insert component with arrows depicting the rotation of various components of the insert.

FIG. 6 shows the gear design of the present application with the direction of the gears shown by rotational arrows. As shown, the pinion gear 140*c* rotates counterclockwise, and by engaging the pinion gear 145, allows the pinion gear 145 to rotate clockwise. The clockwise rotation of the pinion gear 145 is transmitted to the two sets of idler gears 150, which transmit torque to the ratchet gear 155, to rotate the ratchet gear 155 in a counterclockwise direction. Thus, the user can rotate the ratchet gear 155 in a counterclockwise manner by actuating the tool 100 in a manner that rotates the pinion gear 140*c* in a counterclockwise manner. Alternately, the user can reverse the direction of rotation with a switch or a button (not shown), which would thereby rotate the pinion gear 140*c* in a clockwise manner, thereby transmitting torque to the ratchet gear 155 in a clockwise direction.

The manner set forth in the foregoing description and accompanying drawings and examples, is offered by way of illustration only and not as a limitation. More particular embodiments have been shown and described, and it will be apparent to those skilled in the art that changes and modifications may be made without departing from the broader aspects of Applicant's contribution. The actual scope of the protection sought is intended to be defined in the following claims when viewed in their proper prospective based on the prior art.

What is claimed is:

1. A tool, comprising:
- a base having a receiving end;
- a motor coupled to the base;
- a gear train in operable communication with the motor; and
- an interchangeable drive insert removably coupled to the receiving end and engaged with the gear train, the interchangeable drive insert including:
  - a ratchet gear operably coupled to the gear train;
  - a receiving portion operably coupled to the ratchet gear and adapted to engage and apply a rotational force to a work piece; and
  - a retaining arm releasably biased against the base.

2. The tool of claim 1, wherein the ratchet gear includes the receiving portion.

3. The tool of claim 1, wherein the interchangeable drive insert further includes gear teeth and the gear train includes:
- an idler gear engaged with the gear teeth;
- a first pinion gear engaged with the idler gear to apply torque to the idler gear; and
- a second pinion gear engaged with the first pinion gear to apply torque to the first pinion gear.

4. The tool of claim 3, wherein the ratchet gear includes a radial opening and is configured so a radial point of the ratchet gear engages the idler gear during full rotation of the ratchet gear.

5. The tool of claim 3, wherein the gear train further includes upper and lower gears sandwiching the second pinion gear therebetween.

6. The tool of claim 5, wherein the gear train further includes a pawl gear resiliently biased against the upper and lower gears and limiting respective rotational movement of the upper and lower gears in one of a-clockwise and counter-clockwise directions.

7. A tool having an interior portion, comprising:
- a motor;
- a drive body in operable communication with the motor and including upper and lower gears and a first pinion gear disposed therebetween;
- a pawl gear engaged with both the upper and lower gears and extending from the upper gear to the lower gear, the pawl gear limiting respective rotational movement of the upper and lower gears in one of a-clockwise and a-counter-clockwise directions;
- a second pinion gear engaged with the first pinion gear;
- an idler gear engaged with the second pinion gear; and
- a ratchet gear engaged with the idler gear and adapted to apply a rotational force to a work piece based on torque transmitted by the idler gear.

8. The tool of claim 7, wherein the pawl gear is biased against the upper and lower gears.

9. The tool of claim 7, wherein the idler gear includes idler gears disposed along at least two sides of the ratchet gear.

10. The tool of claim 7, wherein the motor transmits torque to the drive body via an offset crank.

11. The tool of claim 7, wherein the ratchet gear is disposed on an interchangeable drive insert that defines a receiving portion adapted to engage and apply the rotational force to the work piece.

12. The tool of claim 11, wherein the interchangeable drive insert further includes a retaining arm adapted to releasably engage the tool.

13. The tool of claim 11, wherein the interchangeable drive insert further includes a support extending from the interchangeable drive insert toward the interior portion of the tool.

14. The tool of claim 11, wherein the ratchet gear defines a radial opening and is configured so a radial point of the ratchet gear engages the idler gear during a full rotation of the ratchet gear.

* * * * *